US010604713B2

(12) United States Patent
Filip

(10) Patent No.: US 10,604,713 B2
(45) Date of Patent: Mar. 31, 2020

(54) METHODS FOR DEMULSIFYING

(71) Applicant: BP OIL INTERNATIONAL LIMITED, Sunbury on Thames, Middlesex (GB)

(72) Inventor: Sorin Vasile Filip, Reading (GB)

(73) Assignee: BP Oil International Limited, Sunbury on Thames, Middlesex (GB)

( * ) Notice: Subject to any disclaimer, the term of this patent is extended or adjusted under 35 U.S.C. 154(b) by 0 days.

(21) Appl. No.: 16/077,460

(22) PCT Filed: Feb. 9, 2017

(86) PCT No.: PCT/EP2017/052924
§ 371 (c)(1),
(2) Date: Aug. 11, 2018

(87) PCT Pub. No.: WO2017/137514
PCT Pub. Date: Aug. 17, 2017

(65) Prior Publication Data

US 2019/0048276 A1 Feb. 14, 2019

(30) Foreign Application Priority Data

Feb. 11, 2016 (EP) ..... 16155213

(51) Int. Cl.
*C10L 1/233* (2006.01)
*C10L 10/10* (2006.01)
*C10L 10/18* (2006.01)

(52) U.S. Cl.
CPC ..... *C10L 1/233* (2013.01); *C10L 1/2335* (2013.01); *C10L 10/10* (2013.01); *C10L 10/18* (2013.01);

(Continued)

(58) Field of Classification Search
CPC combination set(s) only.
See application file for complete search history.

(56) References Cited

U.S. PATENT DOCUMENTS

2009/0306232 A1* 12/2009 Williams ..... C10G 33/04 516/140

FOREIGN PATENT DOCUMENTS

CN 105085504 A 11/2015
DE 2926183 A1 1/1980

(Continued)

OTHER PUBLICATIONS

Han, Jeong Sik et al., "Liquid fuel composition with improved thermal stability", Dec. 2012, XP002759592, retrieved from STN, Database accession No. 2012:1371756.

(Continued)

*Primary Examiner* — Ellen M McAvoy
*Assistant Examiner* — Chantel L Graham
(74) *Attorney, Agent, or Firm* — McDonnell Boehnen Hulbert & Berghoff LLP

(57) ABSTRACT

A method for reducing the propensity of a fuel to form an emulsion comprises combining an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon with the fuel. Thus, the additive may be used as a demulsifier in a fuel.

19 Claims, 4 Drawing Sheets

(52) U.S. Cl.
CPC ..... *C10L 2230/086* (2013.01); *C10L 2230/14* (2013.01); *C10L 2290/24* (2013.01)

(56) References Cited

FOREIGN PATENT DOCUMENTS

| | | | |
|---|---|---|---|
| EP | 0234753 | A1 | 9/1987 |
| WO | 2005/087901 | A2 | 9/2005 |

OTHER PUBLICATIONS

Mizar P et al., "Synthesis of substituted 4-(3-alkyl-1 ,2,4-oxadiazol-5-ylmethyl)-3,4-dihydro-2H-1,4-benzoxazines and 4-(1 H-benzimidazol-2-ylmethyl)-3,4-dihydro-2H-1,4-benzoxazines", Tetrahedron Letters, 47(44): 7823-7826, Oct. 30, 2006.
Goudert, "A new synthesis of 3,4-dihydro-2H-1,4-benzoxalines using solid-liquid phase transfer catalysis", Communications, pp. 541-543, Jul. 1, 1979.
Fu et al., "Simple and efficient synthesis of novel n-dichloroacetyl-3,4-dihydro-2H-1 ,4-benzoxazines", Dec. 2012, XP002759652, Database accession No. 2014:557179.
Mizar P et al., "Synthesis of 2,3-dihydro-6H-1-oxa-3a-azaphenalene and its benzolhetero-fused analog", Journal of Heterocyclic Chemistry, 48(5): 1187-1191, May 5, 2011.
Inoue T et al., "Carboxylic acid compound having URAT1 activity-inhibitory effect, and use thereof", Dec. 2007, XP002759595, retrieved from STN, Database accession No. 2007:841279.
Perry B et al., "Achieving multi-isoform PI3K inhibition in a series of substituted 3,4-dihydro-2Hbenzo[1,4]oxazines", Bioorganic & Medicinal Chemistry Letters, 18(16):4700-4704, Aug. 15, 2008, XP002759654, Database accession No. 2008:960774.
Dominczak N et al., "A very short and efficient palladiumcatalyzed access to the 3,4-dihydro-2H-1,4-benzoxazine structure", Letters in Organic Chemistry, 3(5), 371-373, 2006, XP002759655, retrieved from STN, Database accession No. 2006:623620.
Liu Z et al., "Efficient synthesis of 2,3-dihydro-1,4-benzoxazines via intramolecular copper-catalyzed 0-arylation", Tetrahedron Letters, 50(27): 3790-3793, Jul. 8, 2009.
International Search Report and Written Opinion of the International Search Authority for International Application No. PCT/EP2017/052924, dated Apr. 7, 2017.
Search Report for EP 16155213.8, dated Jul. 22, 2016.

* cited by examiner

METHODS FOR DEMULSIFYING

This application is a national stage application under 35 U.S.C. § 371 of International Application No. PCT/EP2017/052924, filed Feb. 9, 2017, which claims priority to European Patent Application No. EP 16155213.8, filed Feb. 11, 2016, the disclosures of which are explicitly incorporated by reference herein.

FIELD OF THE INVENTION

This invention relates to methods for improving the characteristics of a fuel. In particular, the invention relates to methods in which additives are used to reduce the propensity of a fuel to form an emulsion. Also provided is the use of the additives as demulsifiers.

BACKGROUND OF THE INVENTION

Internal combustion engines are widely used for power, both domestically and in industry. For instance, internal combustion engines are commonly used to power vehicles, such as passenger cars, in the automotive industry.

The operation of an internal combustion engine can, however, be compromised by the presence of water in the fuel which is used in the engine.

Water may be present or introduced into the fuel at any point during its production. For instance, water may be present in the feedstock to the refinery in which the fuel may be prepared. Fuels, and particularly ethanol-containing fuels, are also hygroscopic which means that they may absorb water from the atmosphere, e.g. during transportation, in fuel storage tanks and even in the fuel tank of a vehicle.

Since water and fuel have different densities, then water may simply be removed from a fuel by withdrawal of the denser phase from the bottom of e.g. a tank. However, separation of water and fuel becomes more difficult when they mix to form an emulsion.

The presence of a water-fuel emulsion in an engine can have a number of unwanted consequences. For instance, the water can corrode metal parts in the engine, thereby increasing the frequency at which these parts need to be replaced. Water-fuel emulsions can also block fuel filters in the engine.

Demulsifiers are often added to fuels in order to break the emulsion. Once an emulsion is broken, water will sink and collect underneath the fuel from where it can be readily removed, e.g. in fuel storage tanks.

Common demulsifiers include those that are based on phenolic resins, esters, polyamines, sulfonates or alcohols which are grafted onto polyethylene or polypropylene glycols. These demulsifiers may be used in addition to other additives, which each carry out a specific function. It would desirable for an additive to be effective as an emulsifier, whilst also carrying out another function in the fuel.

There is a need for further methods for reducing the propensity of a fuel to form an emulsion, and for additives which may be used in fuels as demulsifiers.

SUMMARY OF THE INVENTION

Surprisingly, it has now been found that an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon, provides a substantial effect as a demulsifier in a system which comprises a fuel.

Accordingly, the present invention provides a method for reducing the propensity of a fuel to form an emulsion, said method comprising combining an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon with the fuel.

Also provided is the use of an additive described herein as a demulsifier in a fuel.

In preferred embodiments, the demulsifying additive has the formula:

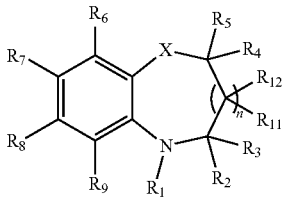

where: $R_1$ is hydrogen;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1.

BRIEF DESCRIPTION OF THE FIGURES

FIG. 1*a* shows a graph of the change in octane number of an E0 fuel having a RON prior to additisation of 90; FIG. 1*b* shows a graph of the change in octane number of an E0 fuel having a RON prior to additisation of 95; and FIG. 1*c* shows a graph of the change in octane number of an E10 fuel having a RON prior to additisation of 95.

FIG. 2*a* shows a graph of the change in octane number of an E0 and an E10 fuel against treat rate; FIG. 2*b* shows a graph of the change in octane number of an E0 fuel at a treat rate of 0.67% w/w; and FIG. 2*c* shows a graph of the change in octane number of an E10 fuel at a treat rate of 0.67% w/w.

DETAILED DESCRIPTION OF THE INVENTION

Demulsifying Additive

Figure 1A:
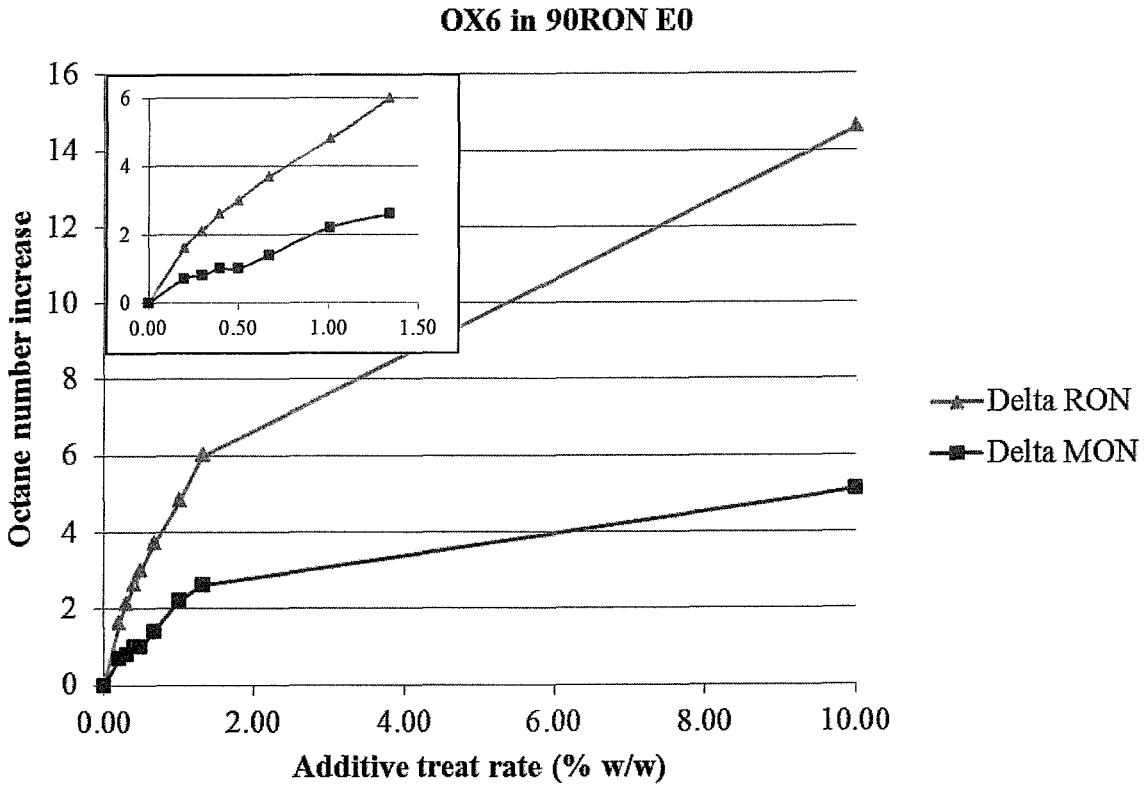
FIGS. 1*a-c* show graphs of the change in octane number (both RON and MON) of fuels when treated with varying amounts of a demulsifying additive described herein. Specifically.

The present invention provides methods and uses in which an additive is used as a demulsifier.

The additive has a chemical structure comprising a 6-membered aromatic ring sharing two adjacent aromatic carbon atoms with a 6- or 7-membered otherwise saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon (referred to in short as a demulsifying additive described herein). As will be appreciated, the 6- or 7-membered heterocyclic ring sharing two adjacent aromatic carbon atoms with the 6-membered aromatic ring may be considered saturated but for those two shared carbon atoms, and may thus be termed "otherwise saturated."

Alternatively stated, the demulsifying additive used in the present invention may be a substituted or unsubstituted 3,4-dihydro-2H-benzo[b][1,4]oxazine (also known as benzomorpholine), or a substituted or unsubstituted 2,3,4,5-tetrahydro-1,5-benzoxazepine. In other words, the additive may be 3,4-dihydro-2H-benzo[b][1,4]oxazine or a derivative thereof, or 2,3,4,5-tetrahydro-1,5-benzoxazepine or a derivative thereof. Accordingly, the additive may comprise one or more substituents and is not particularly limited in relation to the number or identity of such substituents.

Preferred additives have the following formula:

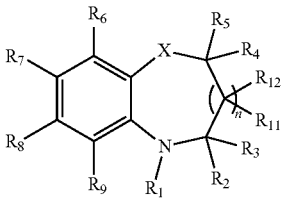

where: $R_1$ is hydrogen;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1.

In some embodiments, $R_2$, $R_3$, $R_4$, $R_5$, $R_{11}$ and $R_{12}$ are each independently selected from hydrogen and alkyl groups, and preferably from hydrogen, methyl, ethyl, propyl and butyl groups. More preferably, $R_2$, $R_3$, $R_4$, $R_5$, $R_{11}$ and $R_{12}$ are each independently selected from hydrogen, methyl and ethyl, and even more preferably from hydrogen and methyl.

In some embodiments, $R_6$, $R_7$, $R_8$ and $R_9$ are each independently selected from hydrogen, alkyl and alkoxy groups, and preferably from hydrogen, methyl, ethyl, propyl, butyl, methoxy, ethoxy and propoxy groups. More preferably, $R_6$, $R_7$, $R_8$ and $R_9$ are each independently selected from hydrogen, methyl, ethyl and methoxy, and even more preferably from hydrogen, methyl and methoxy.

Advantageously, at least one of $R_2$, $R_3$, $R_4$, $R_5$, $R_6$, $R_7$, $R_8$, $R_9$, $R_{11}$ and $R_{12}$, and preferably at least one of $R_6$, $R_7$, $R_8$ and $R_9$, is selected from a group other than hydrogen. More preferably, at least one of $R_7$ and $R_8$ is selected from a group other than hydrogen. Alternatively stated, the demulsifying additive may be substituted in at least one of the positions represented by $R_2$, $R_3$, $R_4$, $R_5$, $R_6$, $R_7$, $R_8$, $R_9$, $R_{11}$ and $R_{12}$, preferably in at least one of the positions represented by $R_6$, $R_7$, $R_8$ and $R_9$, and more preferably in at least one of the positions represented by $R_7$ and $R_8$. It is believed that the presence of at least one group other than hydrogen may improve the solubility of the demulsifying additives in a fuel.

Also advantageously, no more than five, preferably no more than three, and more preferably no more than two, of $R_2$, $R_3$, $R_4$, $R_5$, $R_6$, $R_7$, $R_8$, $R_9$, $R_{11}$ and $R_{12}$ are selected from a group other than hydrogen. Preferably, one or two of $R_2$, $R_3$, $R_4$, $R_5$, $R_6$, $R_7$, $R_8$, $R_9$, $R_{11}$ and $R_{12}$ are selected from a group other than hydrogen. In some embodiments, only one of $R_2$, $R_3$, $R_4$, $R_5$, $R_6$, $R_7$, $R_8$, $R_9$, $R_{11}$ and $R_{12}$ is selected from a group other than hydrogen.

It is also preferred that at least one of $R_2$ and $R_3$ is hydrogen, and more preferred that both of $R_2$ and $R_3$ are hydrogen.

In preferred embodiments, at least one of $R_4$, $R_5$, $R_7$ and $R_8$ is selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen. More preferably, at least one of $R_7$ and $R_8$ are selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen.

In further preferred embodiments, at least one of $R_4$, $R_5$, $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen. More preferably, at least one of $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen.

Preferably, X is —O— or —$NR_{10}$—, where $R_{10}$ is selected from hydrogen, methyl, ethyl, propyl and butyl groups, and preferably from hydrogen, methyl and ethyl groups. More preferably, $R_{10}$ is hydrogen. In preferred embodiments, X is —O—.

n may be 0 or 1, though it is preferred that n is 0.

Demulsifying additives that may be used in the present invention include:

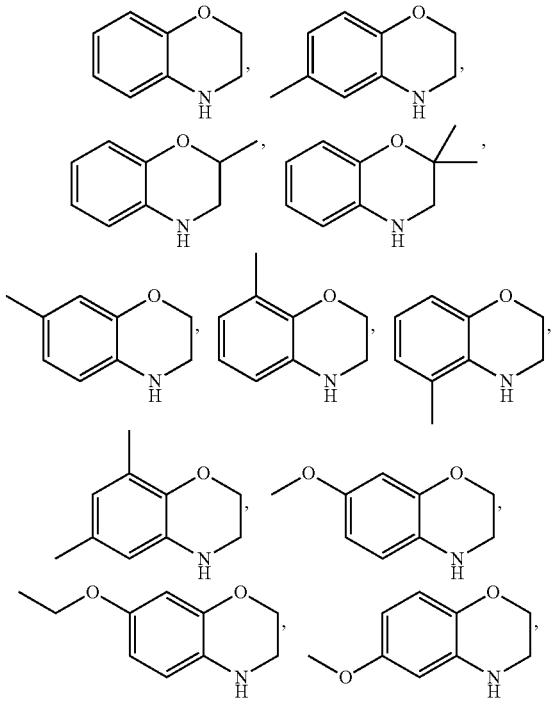

-continued

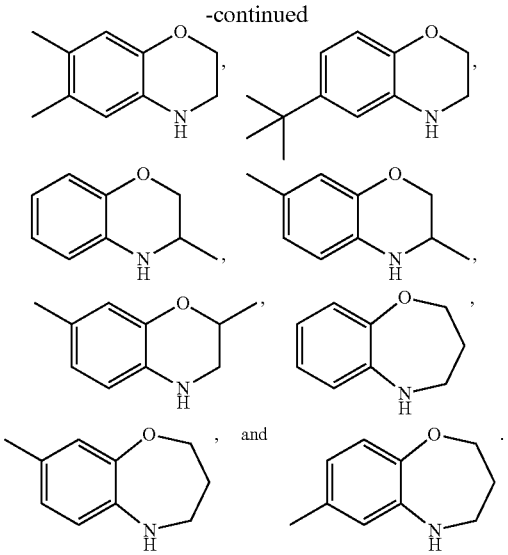

Preferred demulsifying additives include:

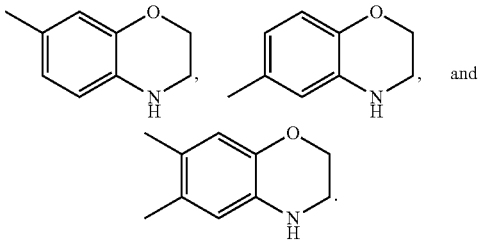

A mixture of additives may be used in the fuel composition. For instance, the fuel composition may comprise a mixture of:

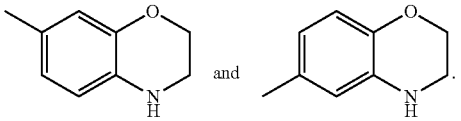

It will be appreciated that references to alkyl groups include different isomers of the alkyl group. For instance, references to propyl groups embrace n-propyl and i-propyl groups, and references to butyl embrace n-butyl, isobutyl, sec-butyl and tert-butyl groups.

Fuel Compositions

The demulsifying additives described herein are used to reduce the propensity of fuel to form an emulsion. Preferably, the fuel is a fuel for an internal combustion engine, e.g. a spark-ignition internal combustion engine. Gasoline fuels (including those containing oxygenates) are typically used in spark-ignition internal combustion engines. Commensurately, the fuel composition according to the present invention may be a gasoline fuel composition.

The demulsifying additives described herein may be combined with the fuel to form a fuel composition. The fuel composition may comprise a major amount (i.e. greater than 50% by weight) of liquid fuel ("base fuel") and a minor amount (i.e. less than 50% by weight) of demulsifying additive described herein, i.e. an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon.

Examples of suitable liquid fuels include hydrocarbon fuels, oxygenate fuels and combinations thereof.

Hydrocarbon fuels that may be used in an internal combustion engine may be derived from mineral sources and/or from renewable sources such as biomass (e.g. biomass-to-liquid sources) and/or from gas-to-liquid sources and/or from coal-to-liquid sources.

Oxygenate fuels that may be used in an internal combustion engine contain oxygenate fuel components, such as alcohols and ethers. Suitable alcohols include straight and/or branched chain alkyl alcohols having from 1 to 6 carbon atoms, e.g. methanol, ethanol, n-propanol, n-butanol, isobutanol, tert-butanol. Preferred alcohols include methanol and ethanol. Suitable ethers include ethers having 5 or more carbon atoms, e.g. methyl tert-butyl ether and ethyl tert-butyl ether.

In some preferred embodiments, the fuel comprises ethanol, e.g. ethanol complying with EN 15376:2014. The fuel may comprise ethanol in an amount of up to 85%, preferably from 1% to 30%, more preferably from 3% to 20%, and even more preferably from 5% to 15%, by volume. For instance, the fuel may contain ethanol in an amount of about 5% by volume (i.e. an E5 fuel), about 10% by volume (i.e. an E10 fuel) or about 15% by volume (i.e. an E15 fuel). A fuel which is free from ethanol is referred to as an E0 fuel.

Ethanol is believed to improve the solubility of the demulsifying additives described herein in the fuel. Thus, in some embodiments, for instance where the demulsifying additive is unsubstituted (e.g. an additive in which $R_1$, $R_2$, $R_3$, $R_4$, $R_5$, $R_6$, $R_7$, $R_8$ and $R_9$ are hydrogen; X is —O—; and n is 0) it may be preferable to use the additive with a fuel which comprises ethanol.

The demulsifying additives are preferably used in a fuel composition which meets particular automotive industry standards. For instance, the fuel composition may have a maximum oxygen content of 2.7% by mass. The fuel composition may have maximum amounts of oxygenates as specified in EN 228, e.g. methanol: 3.0% by volume, ethanol: 5.0% by volume, iso-propanol: 10.0% by volume, iso-butyl alcohol: 10.0% by volume, tert-butanol: 7.0% by volume, ethers (e.g. having 5 or more carbon atoms): 10% by volume and other oxygenates (subject to suitable final boiling point): 10.0% by volume.

The fuel composition may have a sulfur content of up to 50.0 ppm by weight, e.g. up to 10.0 ppm by weight.

Examples of suitable fuel compositions include leaded and unleaded fuel compositions. Preferred fuel compositions are unleaded fuel compositions.

In embodiments, the fuel composition meets the requirements of EN 228, e.g. as set out in BS EN 228:2012. In other embodiments, the fuel composition meets the requirements of ASTM D 4814-14, e.g. as set out in ASTM D 4814-15a. It will be appreciated that the fuel compositions may meet both requirements, and/or other fuel standards.

The fuel composition for an internal combustion engine may exhibit one or more (such as all) of the following, e.g., as defined according to BS EN 228:2012: a minimum research octane number of 95.0, a minimum motor octane number of 85.0 a maximum lead content of 5.0 mg/1, a density of 720.0 to 775.0 kg/m$^3$, an oxidation stability of at least 360 minutes, a maximum existent gum content (solvent washed) of 5 mg/100 ml, a class 1 copper strip corrosion (3 h at 50° C.), clear and bright appearance, a maximum olefin content of 18.0% by weight, a maximum aromatics content of 35.0% by weight, and a maximum benzene content of 1.00% by volume.

The demulsifying additives described herein may be combined with the fuel in an amount of up to 20%, preferably from 0.1% to 10%, and more preferably from 0.2% to 5% weight additive/weight base fuel. Even more preferably, the demulsifying additives may be combined with the fuel in an amount of from 0.25% to 2%, and even more preferably still from 0.3% to 1% weight additive/weight base fuel. It will be appreciated that, when more than one demulsifying additive described herein is used, these values refer to the total amount of demulsifying additive in the fuel.

The demulsifying additive may be used as part of a fuel composition that comprises at least one other further fuel additive.

Examples of such other additives that may be present in the fuel compositions include detergents, friction modifiers/anti-wear additives, corrosion inhibitors, combustion modifiers, anti-oxidants, valve seat recession additives, dyes, markers, odorants, anti-static agents, anti-microbial agents, octane-boosting/improving additives and lubricity improvers.

Further demulsifying additives may also be used in the fuel composition, i.e. demulsifying additives which are not demulsifying additives as described herein, i.e. they do not have a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon.

Examples of suitable detergents include polyisobutylene amines (PIB amines) and polyether amines.

Examples of suitable friction modifiers and anti-wear additives include those that are ash-producing additives or ashless additives. Examples of friction modifiers and anti-wear additives include esters (e.g. glycerol mono-oleate) and fatty acids (e.g. oleic acid and stearic acid).

Examples of suitable corrosion inhibitors include ammonium salts of organic carboxylic acids, amines and heterocyclic aromatics, e.g. alkylamines, imidazolines and tolyltriazoles.

Examples of suitable anti-oxidants include phenolic anti-oxidants (e.g. 2,4-di-tert-butylphenol and 3,5-di-tert-butyl-4-hydroxyphenylpropionic acid) and aminic anti-oxidants (e.g. para-phenylenediamine, dicyclohexylamine and derivatives thereof).

Examples of suitable valve seat recession additives include inorganic salts of potassium or phosphorus.

Examples of suitable octane improvers include non-metallic octane improvers include N-methyl aniline and nitrogen-based ashless octane improvers. Metal-containing octane improvers, including methylcyclopentadienyl manganese tricarbonyl, ferrocene and tetra-ethyl lead, may also be used. However, in preferred embodiments, the fuel composition is free of all added metallic octane improvers including methyl cyclopentadienyl manganese tricarbonyl and other metallic octane improvers including e.g. ferrocene and tetraethyl lead.

Examples of suitable further dehazers/demulsifiers include phenolic resins, esters, polyamines, sulfonates or alcohols which are grafted onto polyethylene or polypropylene glycols.

Examples of suitable markers and dyes include azo or anthraquinone derivatives.

Examples of suitable anti-static agents include fuel soluble chromium metals, polymeric sulfur and nitrogen compounds, quaternary ammonium salts or complex organic alcohols. However, the fuel composition is preferably substantially free from all polymeric sulfur and all metallic additives, including chromium based compounds.

In some embodiments, the fuel composition comprises solvent, e.g. which has been used to ensure that the additives are in a form in which they can be stored or combined with the liquid fuel. Examples of suitable solvents include polyethers and aromatic and/or aliphatic hydrocarbons, e.g. heavy naphtha e.g. Solvesso (Trade mark), xylenes and kerosene.

Representative typical and more typical independent amounts of additives (if present) and solvent in the fuel composition are given in the table below. For the additives, the concentrations are expressed by weight (of the base fuel) of active additive compounds, i.e. independent of any solvent or diluent. Where more than one additive of each type is present in the fuel composition, the total amount of each type of additive is expressed in the table below.

| | Fuel Composition | |
|---|---|---|
| | Typical amount (ppm, by weight) | More typical amount (ppm, by weight) |
| Demulsifying additives described herin | 1000 to 100000 | 2000 to 50000 |
| Detergents | 10 to 2000 | 50 to 300 |
| Friction modifiers and anti-wear additives | 10 to 500 | 25 to 150 |
| Corrosion inhibitors | 0.1 to 100 | 0.5 to 40 |
| Anti-oxidants | 1 to 100 | 10 to 50 |
| Octane-improvers | 0 to 20000 | 50 to 10000 |
| Further dehazers and demulsifiers | 0.05 to 30 | 0.1 to 10 |
| Anti-static agents | 0.1 to 5 | 0.5 to 2 |
| Other additive components | 0 to 500 | 0 to 200 |
| Solvent | 10 to 3000 | 50 to 1000 |

In some embodiments, the additive composition comprises or consists of additives and solvents in the typical or more typical amounts recited in the table above.

Fuel compositions may be produced by a process which comprises combining, e.g. adding or blending, in one or more steps, a fuel for an internal combustion engine with a demulsifying additive described herein. In embodiments in which the fuel composition comprises one or more further fuel additives, the further fuel additives may also be combined, in one or more steps, with the fuel.

In some embodiments, the demulsifying additive may be combined with the fuel in the form of a refinery additive composition or as a marketing additive composition. Thus, the demulsifying additive may be combined with one or more other components (e.g. additives and/or solvents) of the fuel composition as a marketing additive, e.g. at a terminal or distribution point. The demulsifying additive may also be added on its own at a terminal or distribution point. The demulsifying additive may also be combined with one or more other components (e.g. additives and/or solvents) of the fuel composition for sale in a bottle, e.g. for addition to fuel at a later time.

The demulsifying additive and any other additives of the fuel composition may be incorporated into the fuel composition as one or more additive concentrates and/or additive part packs, optionally comprising solvent or diluent.

It will also be appreciated that the demulsifying additive may be added to the fuel in the form of a precursor compound which, under the conditions, e.g. combustion or storage conditions, encountered in a system, for example a fuel system or engine, breaks down to form a demulsifying additive as defined herein.

Uses and Methods

The demulsifying additives disclosed herein may be used in a fuel for a spark-ignition internal combustion engine. Examples of spark-ignition internal combustion engines include direct injection spark-ignition engines and port fuel injection spark-ignition engines. The spark-ignition internal combustion engine may be used in automotive applications, e.g. in a vehicle such as a passenger car.

Examples of suitable direct injection spark-ignition internal combustion engines include boosted direct injection spark-ignition internal combustion engines, e.g. turbocharged boosted direct injection engines and supercharged boosted direct injection engines. Suitable engines include 2.0 L boosted direct injection spark-ignition internal combustion engines. Suitable direct injection engines include those that have side mounted direct injectors and/or centrally mounted direct injectors.

Examples of suitable port fuel injection spark-ignition internal combustion engines include any suitable port fuel injection spark-ignition internal combustion engine including e.g. a BMW 318i engine, a Ford 2.3 L Ranger engine and an MB M111 engine.

The demulsifying additives disclosed herein are used to reduce the propensity of a fuel to form an emulsion. It will therefore be appreciated that emulsions will form less readily and be less stable in a fuel in which a demulsifying additive disclosed herein is used. Thus, the demulsifying additives may be used (e.g. in methods) for preventing the formation of an emulsion in a fuel, or for breaking an emulsion in a fuel.

In some embodiments, the demulsifying additives disclosed herein reduce the propensity of a fuel to form an emulsion/are effective as demulsifiers by reducing the time to complete separation of a fuel and water emulsion or by reducing the rating of the condition of the interface of the emulsion. Preferably, the demulsifying additives reduce the time to complete separation of a fuel. These measurements may be determined according to ASTM D1094-07.

The demulsifying additives disclosed herein may be used to reduce the propensity of a fuel to form an emulsion in a system in which the fuel is used. The system may be e.g. a fuel refinery, a fuel storage tank or a fuel transportation tanker. However, in preferred embodiments, the system comprises an engine, preferably an internal combustion engine and more preferably a spark-ignition internal combustion engine. Thus, the system may be a fuel system in a motorised tool, e.g. a lawn-mower, a power generator or a vehicle, such as an automobile (e.g. a passenger car), a motorcycle or a water-borne vessel (e.g. a ship or a boat). Preferably the fuel system comprises an internal combustion engine, and more preferably a spark-ignition internal combustion engine.

The demulsifying additive is preferably introduced into the system with the fuel e.g. as part of a fuel composition (such as a fuel composition described above). For instance, in embodiments in which the system is a fuel system in a vehicle, the method may comprise combining (e.g. by adding, blending or mixing) the demulsifying additive with the fuel in a fuel refinery, at a fuel terminal, or at a fuel pump to form a fuel composition, and introducing the fuel composition into the fuel system of the vehicle, e.g. into the fuel tank.

The methods may further comprise delivering the fuel composition to an internal combustion engine, e.g. a spark-ignition internal combustion engine, and/or operating the internal combustion engine.

The demulsifying additives disclosed herein may also be used to increase the octane number of a fuel for a spark-ignition internal combustion engine. Thus, the demulsifying additives may be used as a multi-purpose fuel additive.

In some embodiments, the demulsifying additives increase the RON or the MON of the fuel. In preferred embodiments, the demulsifying additives increase the RON of the fuel, and more preferably the RON and MON of the fuel. The RON and MON of the fuel may be tested according to ASTM D2699-15a and ASTM D2700-13, respectively.

Since the demulsifying additives described herein increase the octane number of a fuel for a spark-ignition internal combustion engine, they may also be used to address abnormal combustion that may arise as a result of a lower than desirable octane number. Thus, the demulsifying additives may be used for improving the auto-ignition characteristics of a fuel, e.g. by reducing the propensity of a fuel for at least one of auto-ignition, pre-ignition, knock, mega-knock and super-knock, when used in a spark-ignition internal combustion engine.

The invention will now be described with reference to the following non-limiting examples.

EXAMPLES

Example 1: Preparation of Demulsifying Additives

The following demulsifying additives were prepared using standard methods:

OX1

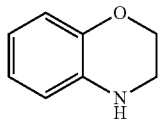

OX2

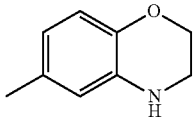

OX3

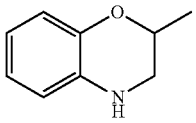

OX4

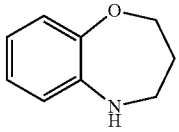

-continued

OX5

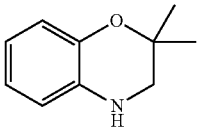

OX6

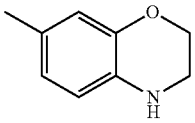

OX7

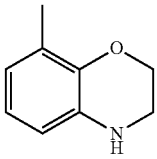

OX8

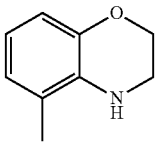

OX9

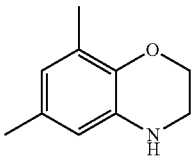

OX10

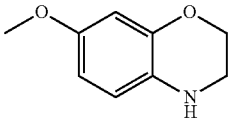

OX11

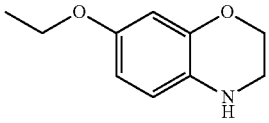

OX12

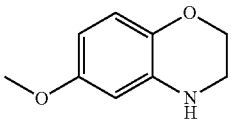

OX13

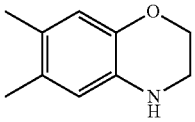

OX14

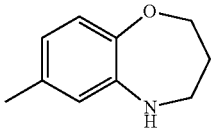

OX15

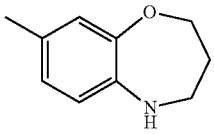

-continued

OX16

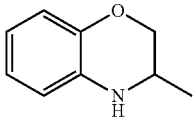

OX17

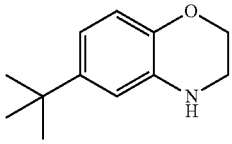

OX18

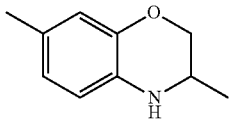

OX19

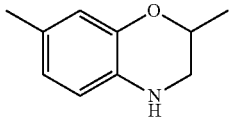

Example 2: Effect of Demulsifying Additive on the Stability of an Emulsion

The effect of a demulsifying additive from Example 1 (OX6) on the stability of an emulsion in two different base fuels for a spark-ignition internal combustion engine was measured.

The demulsifying additive was added to the fuels at a treat rate of 1.34% weight additive/weight base fuel, equivalent to a treat rate of 10 g additive/fuel. The first fuel was an E0 gasoline base fuel. The second fuel was an E10 gasoline base fuel.

The emulsion characteristics of the base fuels, as well as the blends of base fuel and demulsifying additive, were determined according to an in-house method based on ASTM D1094.

The following table shows the stability of the emulsion that was observed in the gasoline base fuels and the blends of base fuel and demulsifying additive.

| Gasoline | Treat rate (% w/w) | Time to complete separation (minutes) | Interface volume (ml), and rating: After 1 minute | Interface volume (ml), and rating: After 5 minutes |
|---|---|---|---|---|
| E0 | 0.00 | 3.0 | clear, no emulsion | clear, no emulsion |
| | 1.34 | 0.2 | <0.5, shreds | clear, no emulsion |
| E10 | 0.00 | 4.5 | 1.0, emulsion with bubbles | <0.1, shreds |
| | 1.34 | 1.0 | clear, no emulsion | clear, no emulsion |

It can be seen that the demulsifying additive may be used to reduce the stability of an emulsion in an ethanol-free and ethanol-containing fuel for a spark-ignition internal combustion engine.

Example 3: Octane Number of Fuels Containing Demulsifying Additives

The effect of demulsifying additives from Example 1 (OX1, OX2, OX3, OX5, OX6, OX8, OX9, OX12, OX13, OX17 and OX19) on the octane number of two different base fuels for a spark-ignition internal combustion engine was measured.

The additives were added to the fuels at a relatively low treat rate of 0.67% weight additive/weight base fuel, equivalent to a treat rate of 5 g additive/litre of fuel. The first fuel was an E0 gasoline base fuel. The second fuel was an E10 gasoline base fuel. The RON and MON of the base fuels, as well as the blends of base fuel and demulsifying additive, were determined according to ASTM D2699 and ASTM D2700, respectively.

The following table shows the RON and MON of the fuel and the blends of fuel and demulsifying additive, as well as the change in the RON and MON that was brought about by using the demulsifying additives:

| | E0 base fuel | | | | E10 base fuel | | | |
|---|---|---|---|---|---|---|---|---|
| Additive | RON | MON | ΔRON | ΔMON | RON | MON | ΔRON | ΔMON |
| — | 95.4 | 86.0 | n/a | n/a | 95.4 | 85.2 | n/a | n/a |
| OX1 | — | — | — | — | 97.3 | 86.3 | 1.9 | 1.1 |
| OX2 | 97.7 | 87.7 | 2.3 | 1.7 | 97.8 | 86.5 | 2.4 | 1.3 |
| OX3 | 97.0 | 86.7 | 1.6 | 0.7 | 97.1 | 85.5 | 1.7 | 0.3 |
| OX5 | 97.0 | 86.5 | 1.6 | 0.5 | 97.1 | 85.5 | 1.7 | 0.3 |
| OX6 | 98.0 | 87.7 | 2.6 | 1.7 | 98.0 | 86.8 | 2.6 | 1.6 |
| OX8 | 96.9 | 86.1 | 1.5 | 0.1 | 96.9 | 85.7 | 1.5 | 0.5 |
| OX9 | 97.6 | 86.9 | 2.2 | 0.9 | 97.6 | 86.5 | 2.2 | 1.3 |
| OX12 | 97.4 | 86.3 | 2.0 | 0.3 | 97.3 | 86.1 | 1.9 | 0.9 |
| OX13 | 97.9 | 86.5 | 2.5 | 0.5 | 97.7 | 86.1 | 2.3 | 0.9 |
| OX17 | 97.5 | 86.4 | 2.1 | 0.4 | 97.4 | 86.4 | 2.0 | 1.2 |
| OX19 | 97.4 | 86.1 | 2.0 | 0.1 | 97.6 | 85.9 | 2.2 | 0.7 |

It can be seen that the demulsifying additives may be used to increase the RON of an ethanol-free and an ethanol-containing fuel for a spark-ignition internal combustion engine.

Further additives from Example 1 (OX4, OX7, OX10, OX11, OX14, OX15, OX16 and OX18) were tested in the E0 gasoline base fuel and the E10 gasoline base fuel. Each of the additives increased the RON of both fuels, aside from OX7 where there was insufficient additive to carry out analysis with the ethanol-containing fuel.

Example 4: Variation of Octane Number with Demulsifying Additive Treat Rate

The effect of a demulsifying additive from Example 1 (OX6) on the octane number of three different base fuels for a spark-ignition internal combustion engine was measured over a range of treat rates (% weight additive/weight base fuel).

The first and second fuels were E0 gasoline base fuels. The third fuel was an E10 gasoline base fuel. As before, the RON and MON of the base fuels, as well as the blends of base fuel and demulsifying additive, were determined according to ASTM D2699 and ASTM D2700, respectively.

The following table shows the RON and MON of the fuels and the blends of fuel and demulsifying additive, as well as the change in the RON and MON that was brought about by using the demulsifying additives:

| | Additive treat rate | Octane number | | | |
|---|---|---|---|---|---|
| | (% w/w) | RON | MON | ΔRON | ΔMON |
| E0 90 RON | 0.00 | 89.9 | 82.8 | 0.0 | 0.0 |
| | 0.20 | 91.5 | 83.5 | 1.6 | 0.7 |
| | 0.30 | 92.0 | 83.6 | 2.1 | 0.8 |
| | 0.40 | 92.5 | 83.8 | 2.6 | 1.0 |
| | 0.50 | 92.9 | 83.8 | 3.0 | 1.0 |
| | 0.67 | 93.6 | 84.2 | 3.7 | 1.4 |
| | 1.01 | 94.7 | 85.0 | 4.8 | 2.2 |
| | 1.34 | 95.9 | 85.4 | 6.0 | 2.6 |
| | 10.00 | 104.5 | 87.9 | 14.6 | 5.1 |
| E0 95 RON | 0.00 | 95.2 | 85.6 | 0.0 | 0.0 |
| | 0.10 | 95.9 | 85.8 | 0.7 | 0.2 |
| | 0.20 | 96.4 | 86.3 | 1.2 | 0.7 |
| | 0.30 | 96.6 | 86.8 | 1.4 | 1.2 |
| | 0.40 | 97.1 | 86.6 | 1.9 | 1.0 |
| | 0.50 | 97.3 | 87.0 | 2.1 | 1.4 |
| | 0.60 | 97.5 | 86.8 | 2.3 | 1.2 |
| | 0.70 | 97.8 | 86.8 | 2.6 | 1.2 |
| | 0.80 | 98.0 | 87.3 | 2.8 | 1.7 |

-continued

| | Additive treat rate | Octane number | | | |
|---|---|---|---|---|---|
| | (% w/w) | RON | MON | ΔRON | ΔMON |
| | 0.90 | 98.5 | 86.8 | 3.3 | 1.2 |
| | 1.00 | 98.7 | 86.9 | 3.5 | 1.3 |
| | 10.00 | 105.7 | 88.7 | 10.5 | 3.1 |
| E10 95 RON | 0.00 | 95.4 | 85.1 | 0.0 | 0.0 |
| | 0.10 | 95.9 | 85.2 | 0.5 | 0.1 |
| | 0.20 | 96.3 | 86.3 | 0.9 | 1.2 |
| | 0.30 | 96.8 | 86.3 | 1.4 | 1.2 |
| | 0.40 | 96.9 | 85.8 | 1.5 | 0.7 |
| | 0.50 | 97.3 | 85.9 | 1.9 | 0.8 |
| | 0.60 | 97.4 | 85.9 | 2.0 | 0.8 |
| | 0.70 | 97.9 | 86.0 | 2.5 | 0.9 |
| | 0.80 | 98.2 | 86.8 | 2.8 | 1.7 |
| | 0.90 | 98.7 | 86.3 | 3.3 | 1.2 |
| | 1.00 | 98.8 | 86.5 | 3.4 | 1.4 |
| | 10.00 | 105.1 | 87.8 | 9.7 | 2.7 |

Figure 1B:
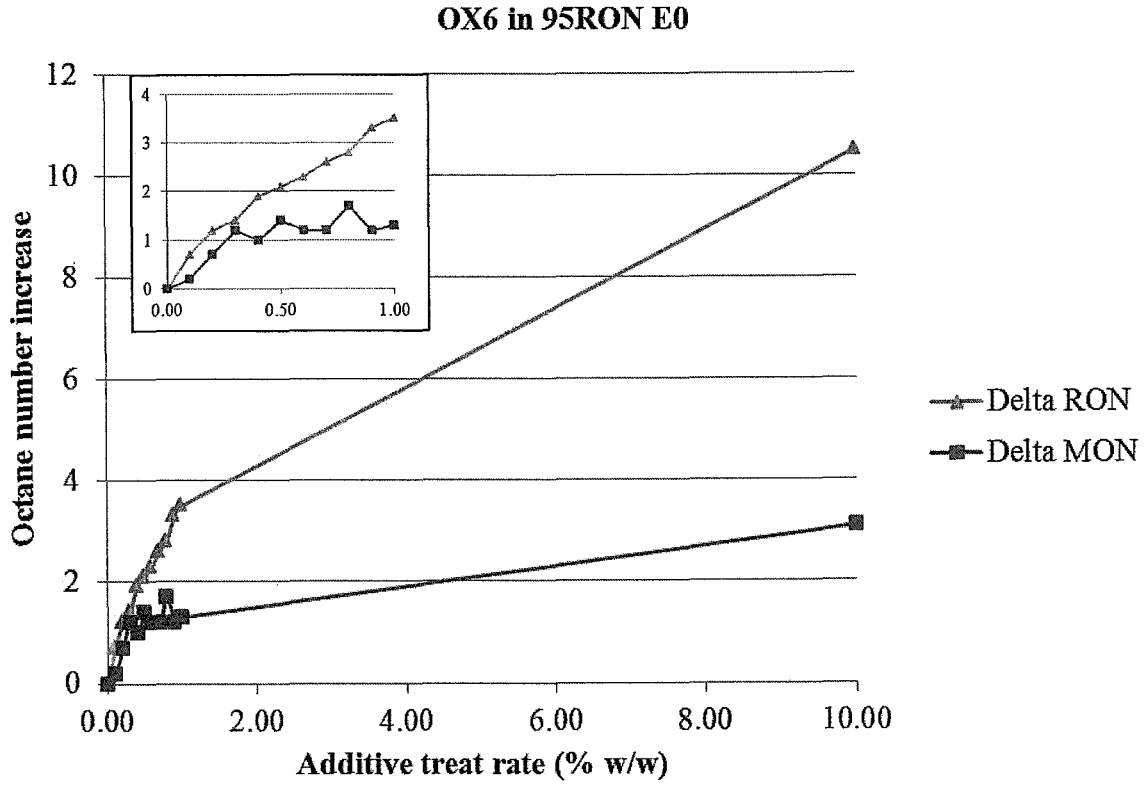
Figure 1C:
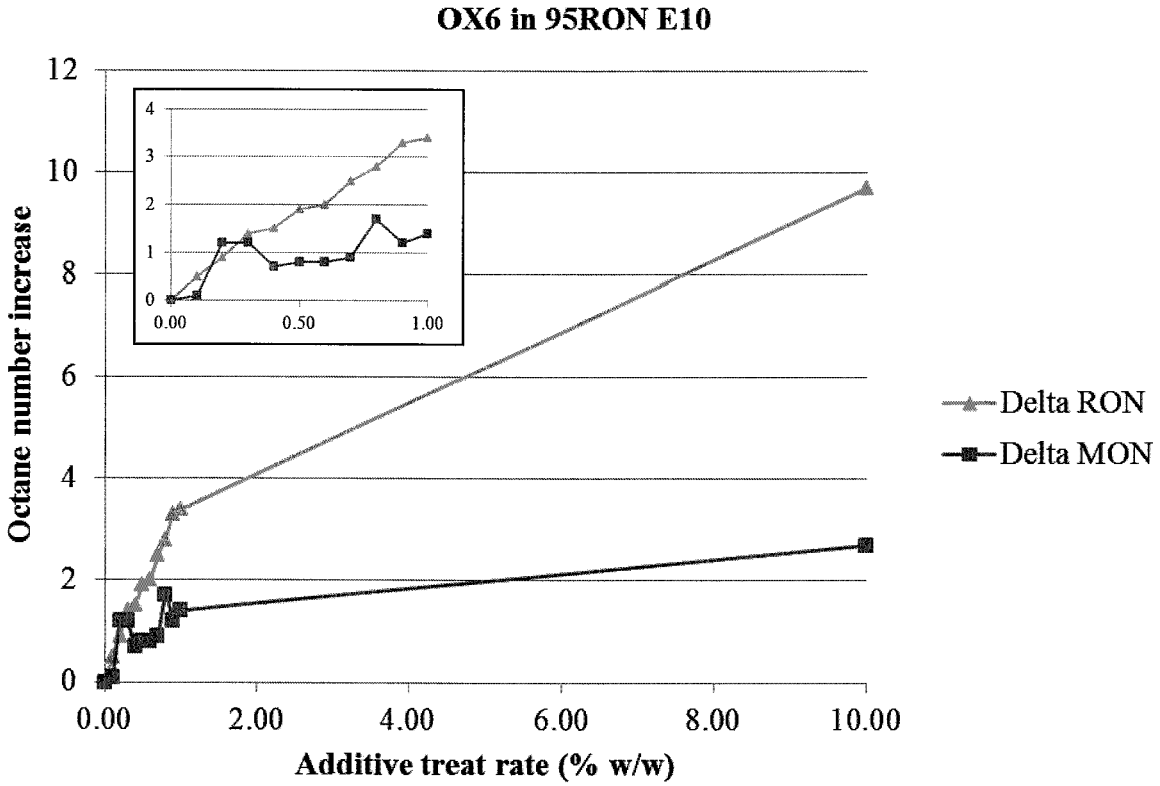

Graphs of the effect of the demulsifying additive on the RON and MON of the three fuels are shown in FIGS. 1*a-c*. It can be seen that the demulsifying additive had a significant effect on the octane numbers of each of the fuels, even at very low treat rates.

Example 5: Comparison of Demulsifying Additive with N-Methyl Aniline

The effect of demulsifying additives from Example 1 (OX2 and OX6) was compared with the effect of N-methyl aniline on the octane number of two different base fuels for a spark-ignition internal combustion engine over a range of treat rates (% weight additive/weight base fuel).

The first fuel was an E0 gasoline base fuel. The second fuel was an E10 gasoline base fuel. As before, the RON and MON of the base fuels, as well as the blends of base fuel and demulsifying additive, were determined according to ASTM D2699 and ASTM D2700, respectively.

Figure 2A:
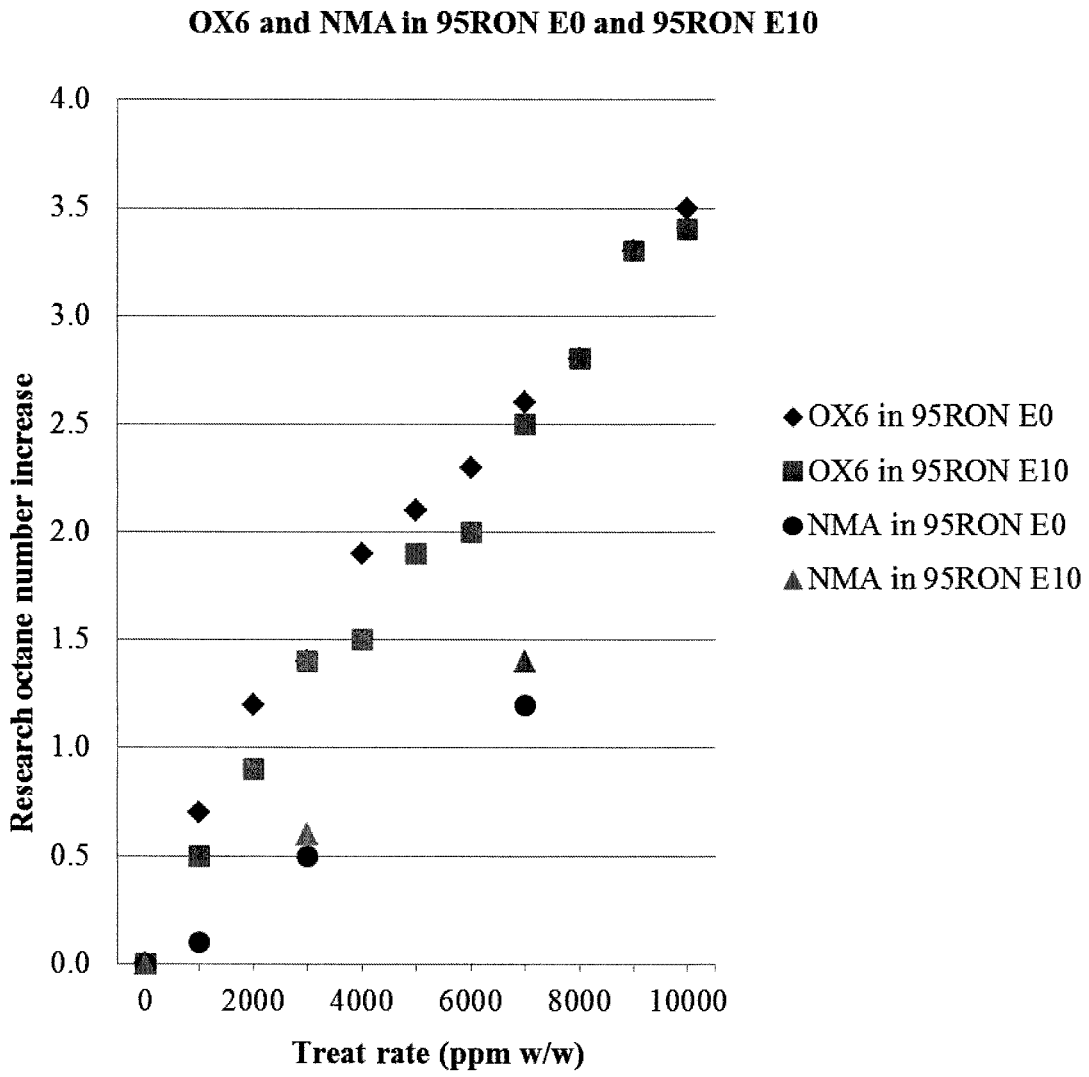
FIGS. 2*a-c* show graphs comparing the change in octane number (both RON and MON) of fuels when treated with demulsifying additives described herein and N-methyl aniline. Specifically.

A graph of the change in octane number of the E0 and E10 fuels against treat rate of N-methyl aniline and a demulsifying additive (OX6) is shown in FIG. 2*a*. The treat rates are typical of those used in a fuel. It can be seen from the graph that the performance of the demulsifying additive described herein is significantly better than that of N-methyl aniline across the treat rates.

Figure 2B:
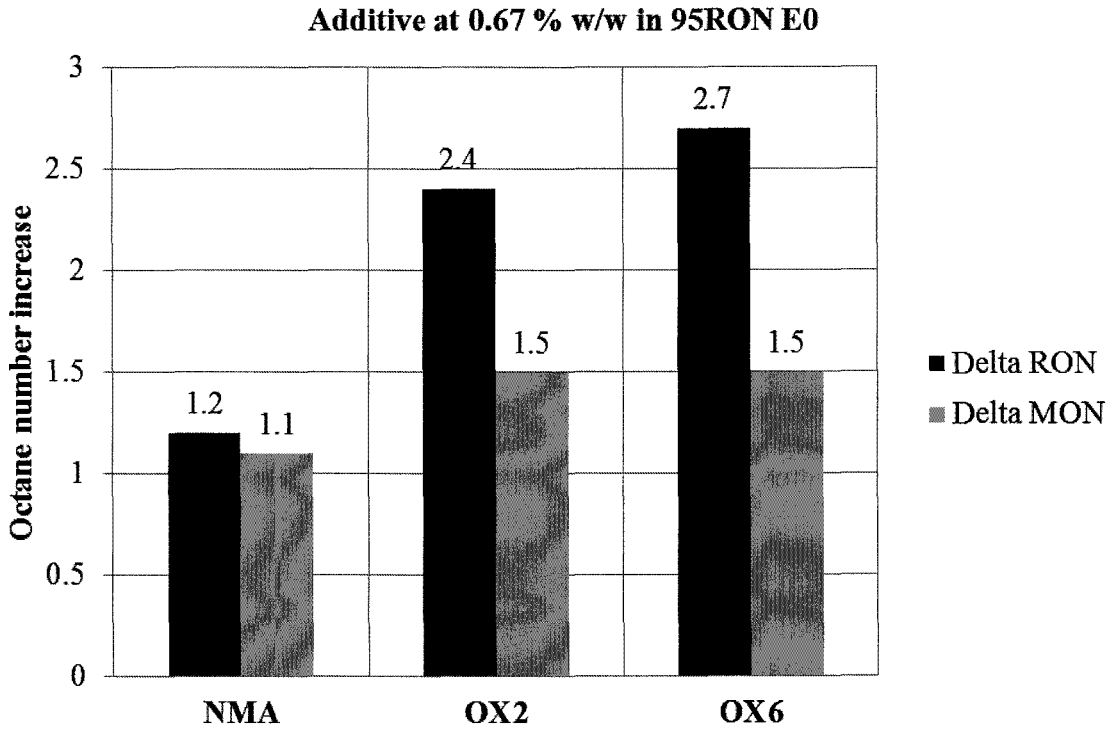
Figure 2C:
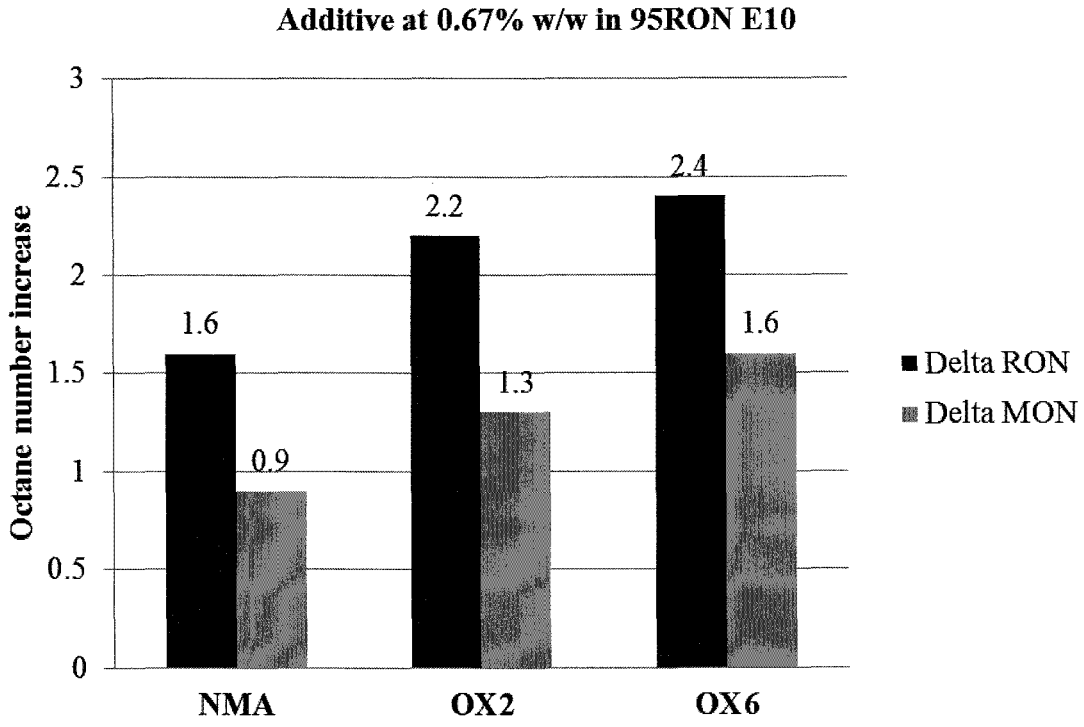

A comparison of the effect of two demulsifying additives (OX2 and OX6) and N-methyl aniline on the octane number of the E0 and E10 fuels at a treat rate of 0.67% w/w is shown in FIGS. 2*b* and 2*c*. It can be seen from the graph that the performance of demulsifying additives described herein is significantly superior to that of N-methyl aniline. Specifically, an improvement of about 35% to about 50% is observed for the RON, and an improvement of about 45% to about 75% is observed for the MON.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope and spirit of this invention.

The invention claimed is:

1. A method for reducing the propensity of a fuel to form an emulsion, said method comprising combining an additive with the fuel, wherein the additive has the formula:

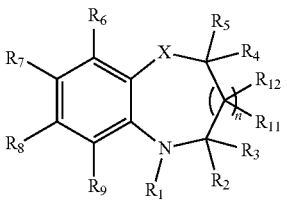

where:

$R_1$ is hydrogen;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1.

2. A method according to claim 1, wherein $R_2$, $R_3$, $R_4$, $R_5$, $R_{11}$ and $R_{12}$ are each independently selected from hydrogen and alkyl groups.

3. A method according to claim 1, wherein $R_6$, $R_7$, $R_8$ and $R_9$ are each independently selected from hydrogen, alkyl and alkoxy groups.

4. A method according to claim 1, wherein at least one of $R_2$, $R_3$, $R_4$, $R_5$, $R_6$, $R_7$, $R_8$, $R_9$, $R_{11}$ and $R_{12}$ is selected from a group other than hydrogen.

5. A method according to claim 1, wherein no more than five of $R_2$, $R_3$, $R_4$, $R_5$, $R_6$, $R_7$, $R_8$, $R_9$, $R_{11}$ and $R_{12}$ are selected from a group other than hydrogen.

6. A method according to claim 1, wherein at least one of $R_2$ and $R_3$ is hydrogen.

7. A method according to claim 1, wherein at least one of $R_4$, $R_5$, $R_7$ and $R_8$ is selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen.

8. A method according to claim 7, wherein at least one of $R_4$, $R_5$, $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen.

9. A method according to claim 1, wherein X is —O— or —$NR_{10}$—, where $R_{10}$ is selected from hydrogen, methyl, ethyl, propyl and butyl groups.

10. A method according to claim 1, wherein n is 0.

11. A method according to claim 1, wherein the additive is selected from:

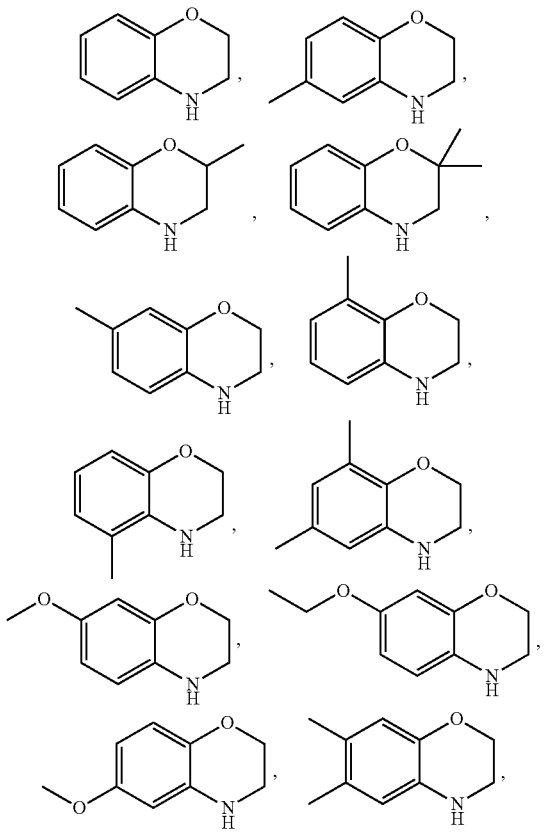

-continued

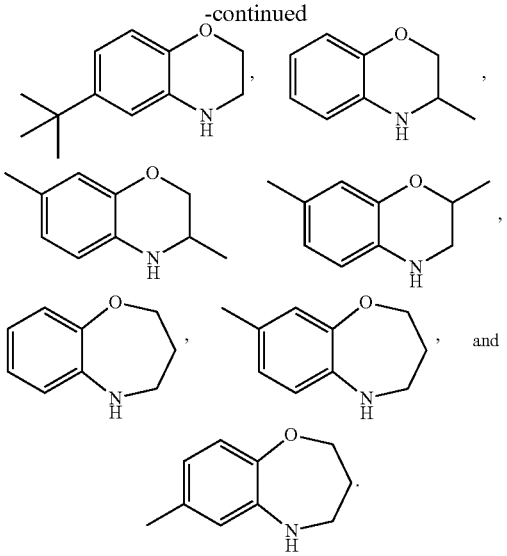

12. A method according to claim 1, wherein the additive is combined with the fuel composition in an amount of up to 20% weight additive/weight base fuel.

13. A method according to claim 1, wherein ethanol is present in the fuel in an amount of up to 85% by volume.

14. A method according to claim 1, wherein the method is for improving the octane number of a fuel.

15. A method according to claim 1, wherein the fuel is present in a fuel refinery, a fuel storage tank, or a fuel transportation tanker.

16. A method according to claim 1, wherein the fuel is present in a system which comprises an engine.

17. A method according to claim 16, wherein the system is a fuel system in an automobile, a motorcycle, or a water-borne vessel.

18. A method according to claim 16, wherein the method reduces the propensity of the fuel for at least one of auto-ignition, pre-ignition, knock, mega-knock and super-knock when used in a spark-ignition internal combustion engine.

19. A method according to claim 1, wherein X is —O—.

* * * * *